US005758674A

United States Patent [19]

Taeger

[11] Patent Number: 5,758,674

[45] Date of Patent: Jun. 2, 1998

[54] STANCHION-SUPPORTED APPARATUS

[76] Inventor: Jerry D. Taeger, 6831 Axelrod Way, Wesley Chapel, Fla. 33544

[21] Appl. No.: 639,587

[22] Filed: Apr. 29, 1996

[51] Int. Cl.[6] ..... B08B 15/02

[52] U.S. Cl. ..... 134/131; 134/122 R; 134/199; 134/200; 312/228

[58] Field of Search ..... 134/72, 131, 122 R, 134/199, 200; 312/228; 118/DIG. 7

[56] References Cited

U.S. PATENT DOCUMENTS

| | | | |
|---|---|---|---|
| 3,107,676 | 10/1963 | Thorson et al. | 134/199 |
| 3,353,546 | 11/1967 | Mahoney | 134/199 |
| 3,511,252 | 5/1970 | Kennedy | 134/199 |
| 4,326,556 | 4/1982 | Deutsch et al. | 134/114 |
| 4,337,549 | 7/1982 | Anderson | 134/199 |
| 4,723,562 | 2/1988 | Wilmotte et al. | 134/199 |
| 4,729,394 | 3/1988 | Timmes et al. | 134/199 |
| 4,762,139 | 8/1988 | Timmes et al. | 134/199 |
| 4,769,925 | 9/1988 | Matsubara | 118/DIG. 7 |
| 5,162,132 | 11/1992 | Diaz | 118/DIG. 7 |
| 5,630,435 | 5/1997 | Brouchoud et al. | 134/68 |

*Primary Examiner*—Frankie L. Stinson
*Attorney, Agent, or Firm*—Joseph C. Mason, Jr.

[57] ABSTRACT

An apparatus for washing or otherwise treating parts includes a modular support structure for a conveyor from which the parts are suspended and further includes transparent walls that enable visual observation of the treatment process. The support structure includes a plurality of upstanding, longitudinally spaced apart stanchions, each of which has a top piece adapted to engage the uppermost end of a flexible sheet of transparent material such as vinyl. In one embodiment, the lowermost end of each sheet of material is immersed in water contained within an elongate trough that extends along both sides of the apparatus. Thus, a vapor seal is formed that prevents vapors and chemicals from escaping the interior of the apparatus. Dams are placed in the trough at longitudinally spaced intervals to prevent mixing of the chemicals that are collected in the trough. Additional embodiments require no troughs, and include metallic panels that replace or overlie one or more of the vinyl sheets. In all embodiments, the modular structure is inexpensive and facilitates reconfiguration of the structure.

30 Claims, 12 Drawing Sheets

STANCHION-SUPPORTED APPARATUS

BACKGROUND OF THE INVENTION

1. Field of the Invention

This invention relates, generally, to conveyorized washers, cooling tunnels, flash tunnels, dust covers, and similar structures. More particularly, it relates to a modular, chemically resistant construction that enables a user to visually inspect the parts being treated during a treatment process.

2. Description of the Prior Art

Conveyorized washers and similar structures include a series of tanks or stations for spraying, immersing, or otherwise treating parts. The tanks are made of a durable or chemically-resistant material and they are preferably leak-proof.

The preferred materials for such structures are mild steel, stainless steel, and fiberglass. Mild steel is prone to oxidation and deterioration and thus lasts only about 8–10 years. However, it costs less than stainless steel or fiberglass. Stainless steel can last for more than 15 years in most cases, depending upon the chemicals employed in treating the parts, but the cost of stainless steel is much greater than that of mild steel. Fiberglass is about as expensive as stainless steel, and although its makers boast that it can last at least 20 years, such longevity has not yet been established.

All of the known conveyorized washers and similar apparatuses are made of opaque materials. As a result, if a section of the apparatus malfunctions and a part is not cleaned or otherwise properly treated as a result thereof, such malfunction cannot be detected until the part has emerged from the apparatus.

Leakage is another problem with known tunnel constructions. The majority of washers and other tunnels now in use are made of steel and the seams thereof are welded. Due to the time and expense required by the welding procedure, an apparatus having a weld-free construction would be desirable.

Moreover, the known structures are built in accordance with conventional construction techniques, i.e., they are not modular. As a result, they are expensive to construct and cannot easily be expanded or reconfigured if a need arises for additional or different treatment stations.

However, in view of the art at the time the present invention was made, it was not obvious to those of ordinary skill in this art how the limitations of the earlier devices could be overcome.

SUMMARY OF THE INVENTION

The longstanding but heretofore unfulfilled need for an apparatus that overcomes the shortcomings of the prior art structures is now met by a new, useful, and nonobvious invention. The present invention relates to a stanchion support industrial washer or similar apparatus having a plurality of pre-cleaning, cleaning, rinsing, and the like stations disposed along the longitudinal extent of the apparatus. Upstanding stanchions that provide the framework for the apparatus are positioned at predetermined intervals along the extent of the apparatus.

In a first embodiment, a pair of elongate troughs for holding water are disposed along the extent of the structure on transversely spaced apart sides thereof, and each stanchion leg is adapted at its lowermost end for engagement to an associated trough. Sheets of a flexible, transparent sheet material, preferably vinyl, are disposed in overlying relation to the plurality of stanchions, to form the walls of the structure, and said sheets have a lowermost end immersed in water held in the troughs.

Thus, each trough forms a barrier that prevents vapor and chemical spray from escaping the apparatus.

The novel apparatus further includes a dam formed in each of the troughs at predetermined intervals along their respective extents to prevent mixing of chemicals within the troughs.

A drain means in the form of a bottom wall is disposed along the extent of the apparatus when a washer is constructed, and at least one transversely-extending peak is formed in the bottom wall so that a pair of downwardly sloped bottom wall sections flanks each peak so that chemicals falling onto the bottom wall on opposite sides of the peak flow in opposite directions away therefrom.

A sheet material engaging means is positioned atop each stanchion. Said sheet material engaging means is adapted to engage the uppermost ends of the flexible, transparent sheets of material so that an uppermost end of a first sheet of material is engaged by a first part of the engaging means and so that an uppermost end of a second sheet of material is engaged by a second part of the engaging means. Thus, opposite sides of the apparatus are covered by separate sheets of flexible, transparent material.

At least one elongate brace is connected to the stanchions to maintain them in their spaced apart, upright positions.

Additional embodiments require no troughs and have utility as flash tunnels, cooling tunnels, dust covers, and the like.

It is a primary object of this invention to provide an industrial washer, flash tunnel, dust cover, and the like in modular form to substantially reduce the cost of said washers and similar structures.

Another object is to provide an industrial tunnel structure having transparent sidewalls so that the part-treatment process can be viewed white in progress, thereby enabling timely maintenance and adjustment procedures and thereby substantially reducing the number of parts rejected for inadequate treatment.

A related object is to provide a tunnel structure having substantially fewer welds than the tunnel structures heretofore known, yet which is not susceptible to chemical leakage.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
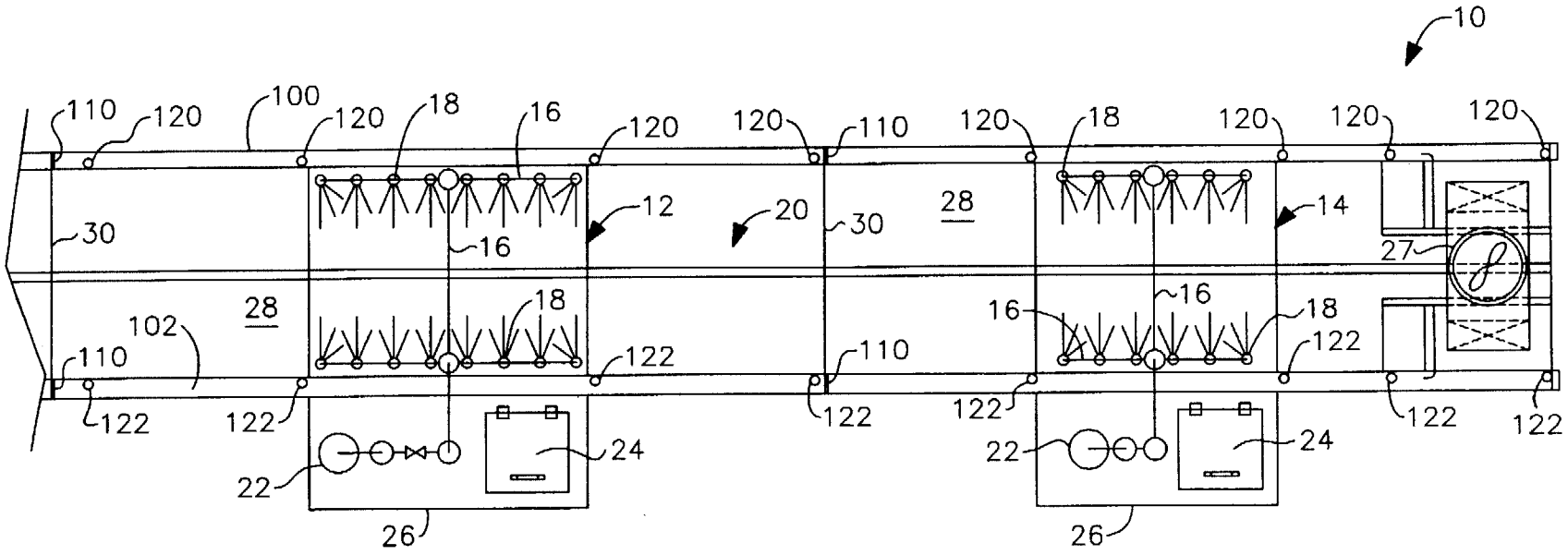
FIG. 1 is a top plan view of an illustrative embodiment of the invention.

Referring now to FIG. 1, it will there be seen that an exemplary embodiment of the invention is denoted as a whole by the reference numeral 10.

The novel stanchion support washer is depicted in plan view in FIG. 1 and is denoted by the reference numeral 10 as a whole.

Washer 10 is a modular structure having a plurality of treatment stations 12, 14, and the like positioned at longitudinally spaced intervals along the length of the apparatus. Each station includes headers (pipes), collectively denoted 16, that deliver liquid solutions to spray nozzles, collectively denoted 18. A central conveyor rail 20 supports a conveyor from which is suspended a plurality of hooks or baskets, not shown, for carrying parts to be cleaned or otherwise treated; the parts advance from station to station along the length of washer 10, being treated with pre-cleaning solvents, cleaning solvents, rinse solutions, heated air, or the like as the application may require. As in conventional washers, liquid chemicals are pumped through the headers 16 by suitable pump and motor means 22 and an access lid 24 facilitates the addition of chemicals and cleaning screens 25 (FIG. 6) to the reservoirs 26. An exhaust fan 27 and associated ductwork perform the respective functions their names express.

Figure 2:
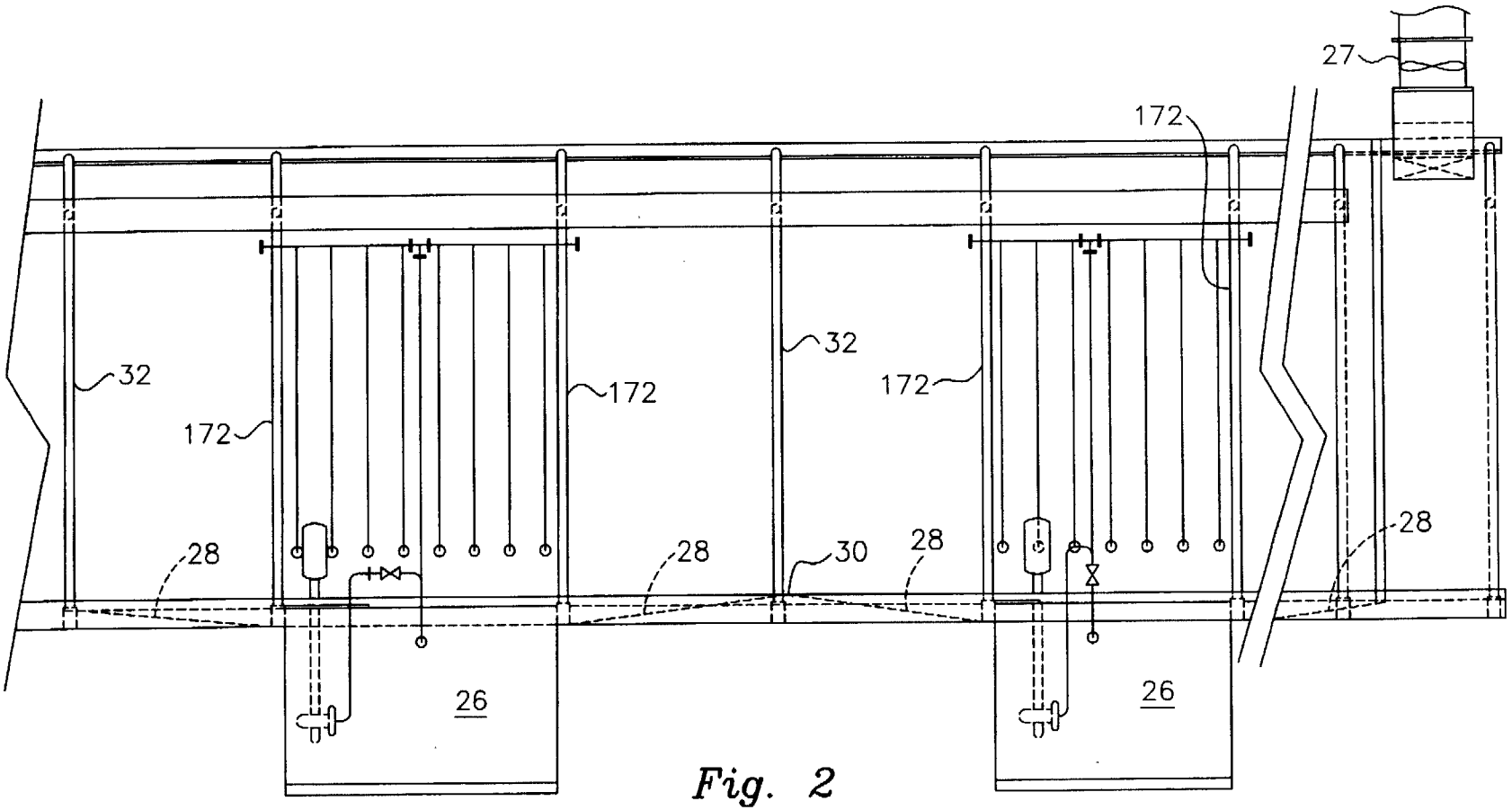
FIG. 2 is a front elevational view thereof.

As best understood in connection with FIG. 2, reservoirs 26 support a longitudinally extending drain board 28 that forms the bottom wall of washer 10. A transversely extending peak 30 is formed in drain board 28 at longitudinally spaced intervals along its extent, as perhaps best understood in connection with FIG. 1. Thus, liquids collected atop the drain board flow away from the peak, i.e., in opposite directions along the extent of the downwardly sloped sections of the bottom wall that flank each peak. The liquids enter a drain means positioned remote from peak 30, i.e., at the lowermost end of the downwardly-sloped sections of the bottom wall. Peaks 30 are positioned midway between stations 12, 14, and the like, as illustrated in FIG. 1; this ensures that liquids from contiguous stations, which may consist of differing chemical solutions, are not mixed with one another.

A plurality of upstanding frame members or stanchions provide the requisite structural strength to support the conventional conveyor means and internal and external headers of this invention. Said stanchions also provide a framework for the novel flexible, transparent walls of the present inventive washer. In FIG. 2, the stanchions are denoted 32 and 172.

Figure 3:
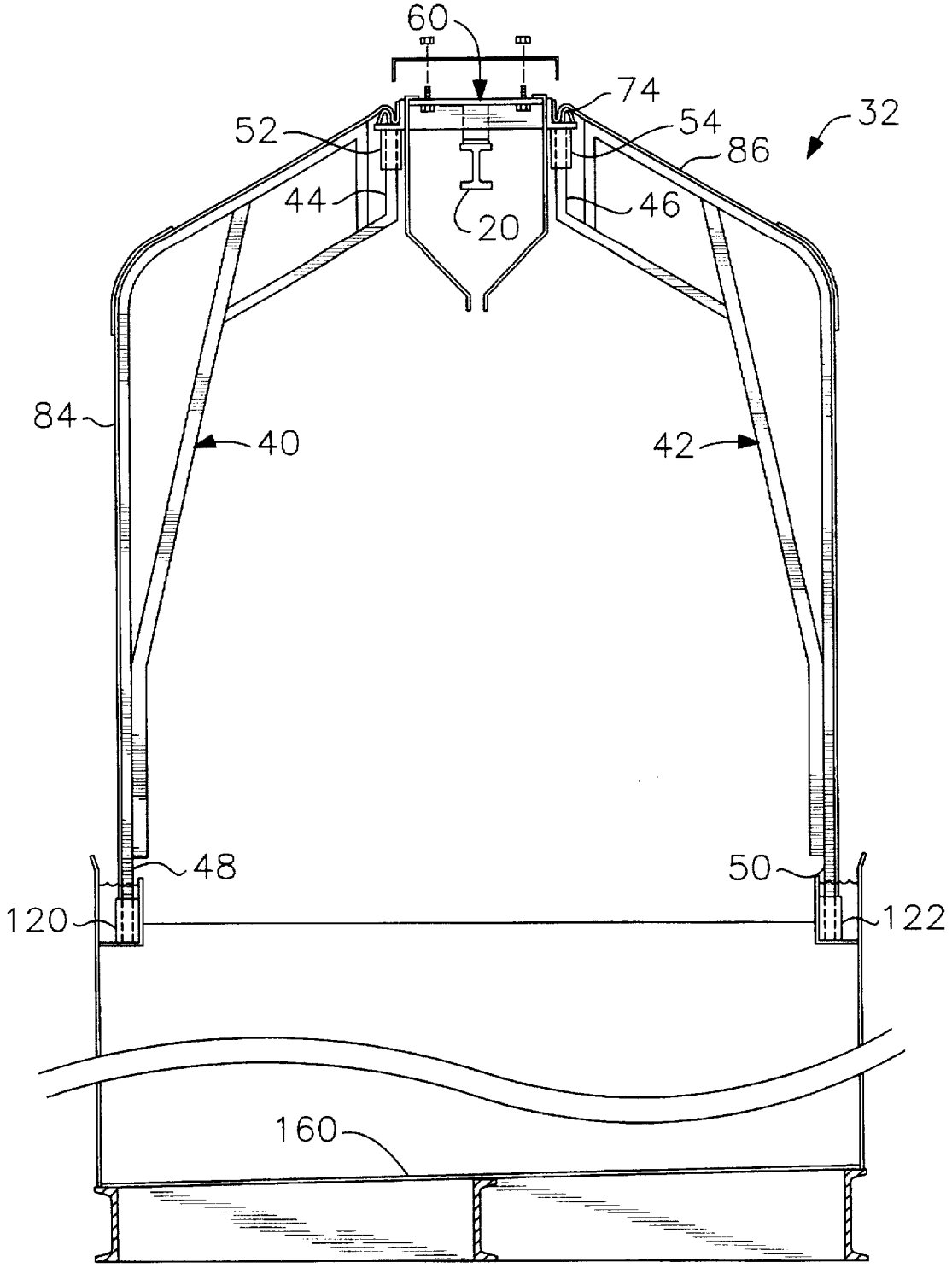
FIG. 3 is an end elevational view of one of the novel stanchions, with one exploded part.
Figure 4:
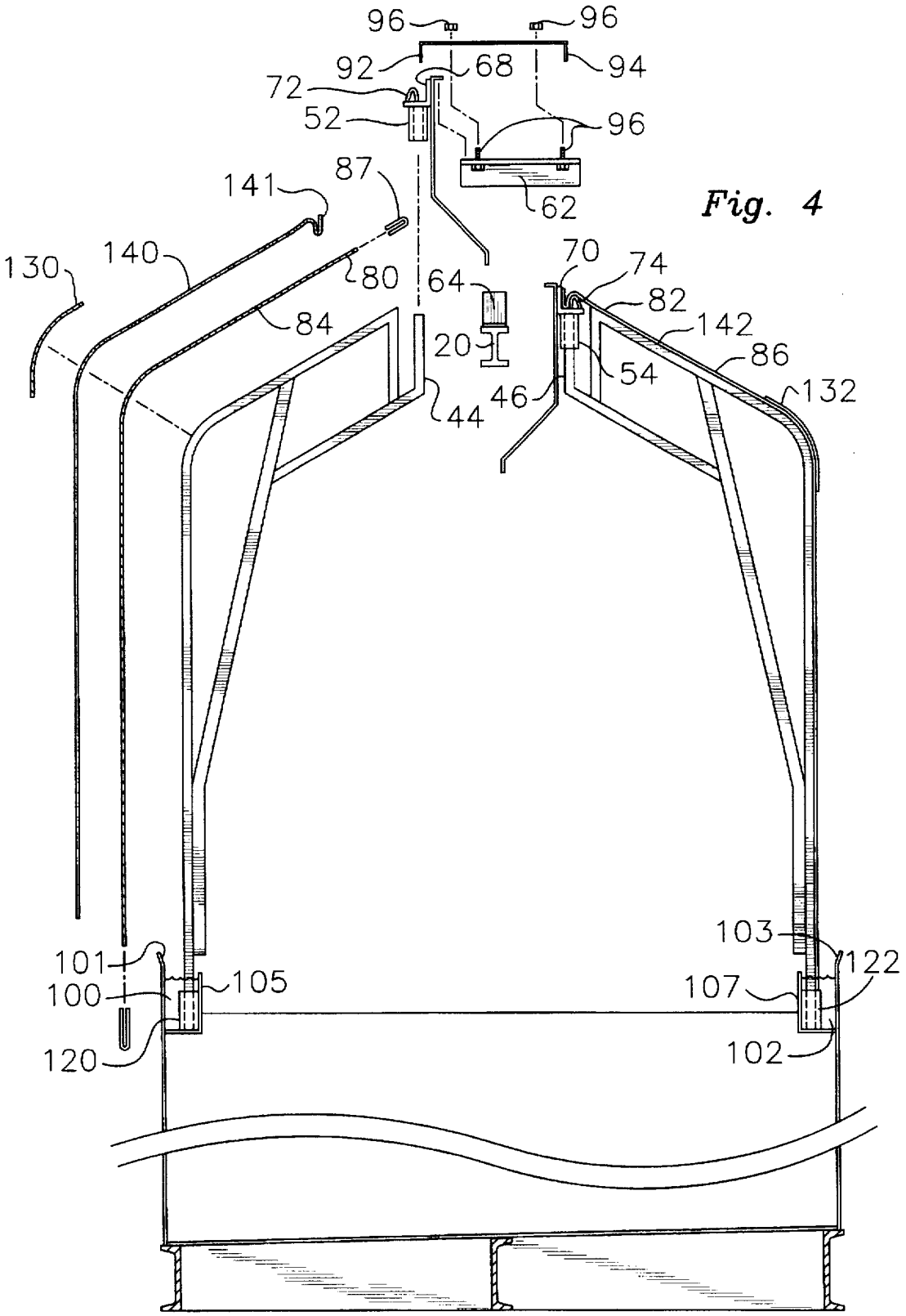
FIG. 4 is an end elevational, partially exploded view of one of the novel stanchions.

As best understood in connection with FIGS. 3 and 4, each stanchion is a frame member having a generally arch-like shape of preselected height and transverse extent (width), depending upon the intended application of the apparatus of which it forms a part. The transverse extent of each stanchion is essentially the transverse extent of the apparatus. The longitudinal extent of each stanchion is nominal, i.e., an inch or two, as best understood in connection with FIG. 2.

Although each stanchion could be made of one or two pieces, assembly of apparatus 10 is best facilitated by providing each stanchion in three parts. As depicted in FIG. 3, parts 40 and 42 of stanchion 32 exhibit bilateral symmetry, i.e., they are mirror images of each other. Stanchion parts 40, 42 respectively include an upper post 44, 46, a lower post 48, 50, and the general framework already indicated generally as 40, 42; the structure of the framework may be provided in innumerable forms so the particular structure depicted, with the possible exception of the upper posts 44, 46 and lower posts 48, 50, is not critical.

Upper posts 44, 46 are slideably received within cylindrical top collars 52, 54, respectively, which collars are a part of the third piece of a stanchion; said third piece, hereinafter referred to as the top piece, is denoted 60 as a whole. As best understood by comparing FIG. 3 with FIG. 4, top piece 60 includes a transversely disposed angle iron 62. A spacer 64 is secured to the lower side of the horizontal flange of said angle iron, and a longitudinally disposed, central conveyor rail 20 in the form of an elongate I beam that extends the entire length of the apparatus is secured by suitable means to said spacer 64 and to like spacers depending from angle irons associated with the other stanchions. I beam 20 supports the conventional conveyor means of washer 10.

A longitudinally disposed, truncate in length angle iron 68, 70 is mounted to opposite ends of angle iron 62; note that top collars 52 and 54 that receive posts 44 and 46, respectively, depend from said angle irons 68, 70. An upwardly projecting prominence 72, 74 is secured to angle irons 68, 70, respectively.

To attach a flexible, transparent sheet of vinyl 84, 86, to opposite ends of top piece 60, the uppermost end 80 of a sheet of vinyl 84 is protected by a U-strip 87 (FIG. 4) and placed in overlying relation to prominence 72; a similar U-strip is placed over the uppermost edge 82 of opposing vinyl sheet 86, and said edge 82 is placed into overlying relation to prominence 74 as indicated.

Retainer 90 (top of FIG. 4), having depending legs 92, 94 at its opposite ends, is then placed into overlying relation to said uppermost edges 80, 82, and said retainer is secured tightly to angle iron 62 by nuts and bolts collectively denoted 96, thereby sandwiching said upper edges 80, 82 between said depending legs 92, 94 and said angle iron 62.

Both vinyl sheets 84, 86, hang freely over stanchions 40, 42 as depicted, it being understood that each vinyl sheet has a longitudinal extent greater than the distance between contiguous stanchions. Thus, the lateral edges of the contiguous vinyl sheets are disposed in overlapping relation relative to one another to provide a sealing means that inhibits leakage of liquids therepast; a twelve inch overlap is believed to be sufficient. Significantly, the transparent sheets are not bonded to one another in any way along their respective contiguous edges but are merely disposed in overlapping relation to one another as aforesaid. This provides a good sealing means and eliminates the time and expense of welding abutting metallic plates together as taught by the prior art.

An elongate, water-filled trough 100, 102 having an imperforate bottom wall is provided along the bottom edge of flexible vinyl sheets 84, 86 to provide a water seal against leakage of chemicals and vapor. Chemicals hitting the inside of the sheets will condense and flow under the influence of gravity into the trough.

The imperforate outer walls 101, 103 of troughs 100, 102, respectively, have a height greater than the height of the respective imperforate inner walls 105, 107 so that if the troughs fill up, the overflow is constrained to flow onto drain plate 28, i.e., such overflow can never flow onto the floor of the facility that houses novel washer apparatus 10.

A dam 110 (FIG. 1) is provided in each trough 100, 102 at the opposite ends of each drain plate 28 to isolate the chemicals in each stage from the chemicals in the contiguous stage, i.e., to prevent contamination from stage to stage.

As depicted in FIG. 4, the lowermost end 48, 50 of each stanchion is slideably received within a bottom collar 120, 122. Said bottom collars are secured to troughs 100, 102 at longitudinally spaced intervals as indicated in FIG. 1; their spacing determines the spacing of the stanchions.

An elongate, longitudinally extending brace 130, 132 is secured to each stanchion as indicated in FIG. 4 to maintain said stanchions in their common upright positions.

As an option, a plurality of opaque metal panels 140 (FIGS. 5A and 5B) having an uppermost end 141 in the form of a channel or other configuration, may be disposed in overlying relation to each vinyl sheet 84, 86 or may be employed in lieu of said vinyl sheets as an application may require or permit. In this particular embodiment, the lowermost end of each metal panel is immersed in the water in its associated trough, just like the lowermost ends of the respective vinyl sheets. A window 139 (FIG. 5A) or a door 143 (FIG. 5B) may be provided as needed; a door having a window may also be provided. Where no viewing of or access into the interior of washer 10 is desired, windowless and doorless metal panels 140 may be used.

Advantageously, the respective contiguous edges of said metal panels may overlap one another; coupled with the immersion of the respective lowermost ends of said metal panels in water as aforesaid, there is no need for any welding. Metal panels 140 are most advantageously employed in overlying relation to the vinyl sheets at the opposite ends of washer 10, i.e., at the entrance and exit thereof, to provide lateral support for the entire structure. Such metal panels also provide a solid support surface to which the opposite ends of elongate braces 130, 132 (FIG. 4) may be secured.

Figure 5:
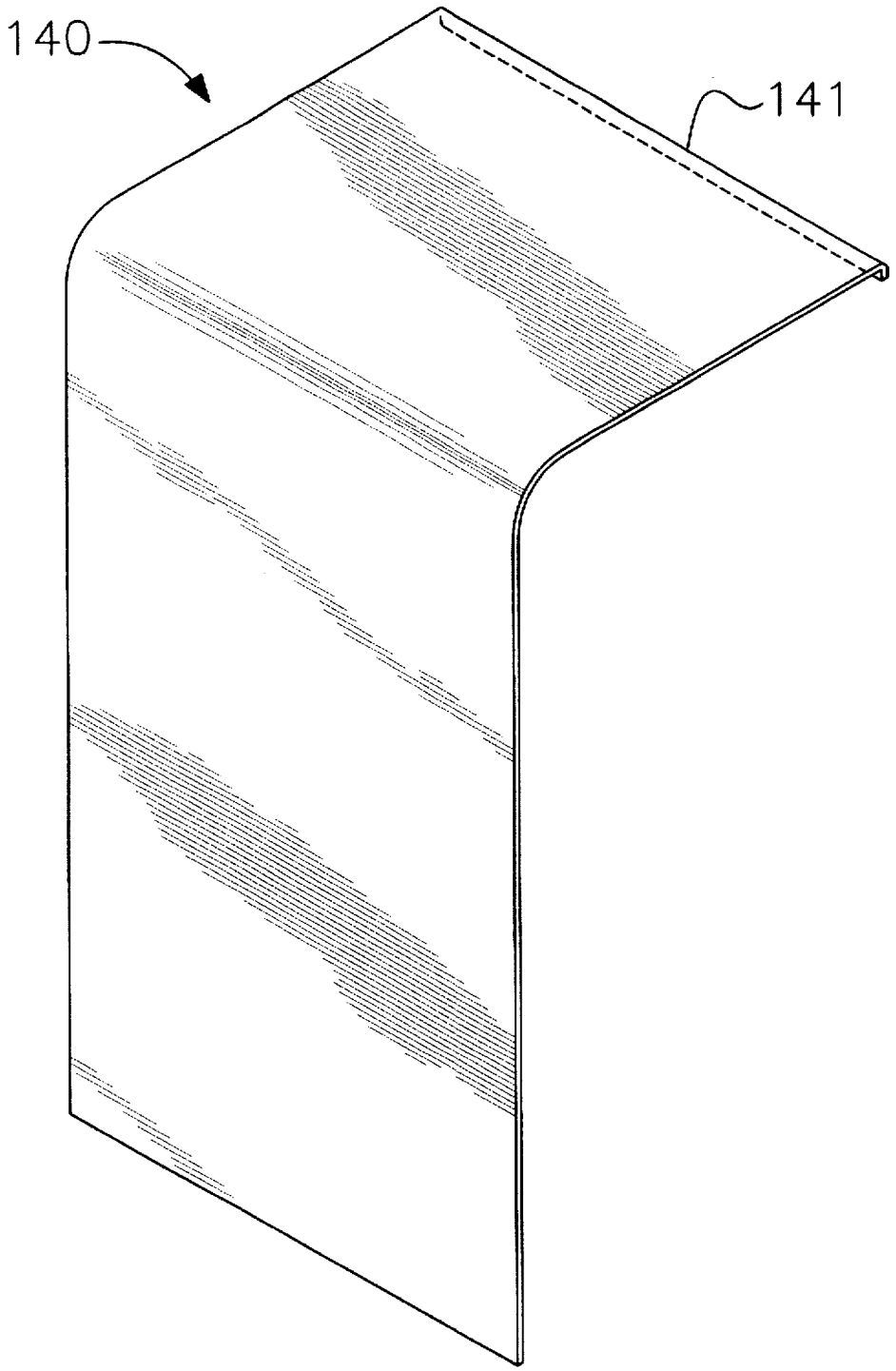
FIG. 5A is a perspective view of a novel metallic panel fitted with a window.
FIG. 5B is a perspective view of a novel metallic panel fitted with a door.
Figure 6:
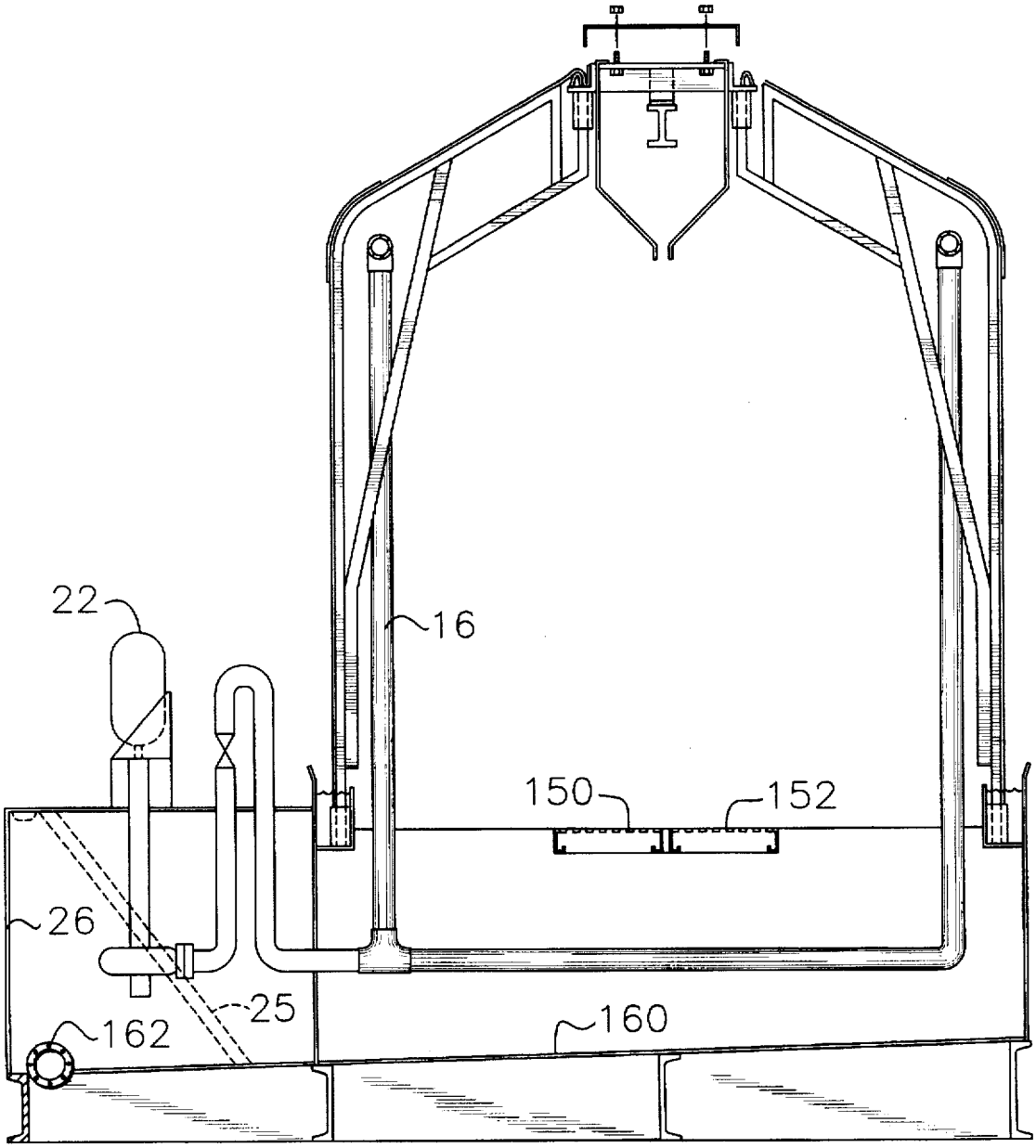
FIG. 6 is a partial end elevational view of one of the novel stanchions and associated parts.

FIG. 6 depicts another optional element, i.e., removable walk boards 150, 152 that may be positioned along the longitudinal extent of the washer or similar device to facilitate inspections and repairs therewithin. FIG. 5 also depicts sloped floor 160 that directs fluids to drain 162.

Figure 7:
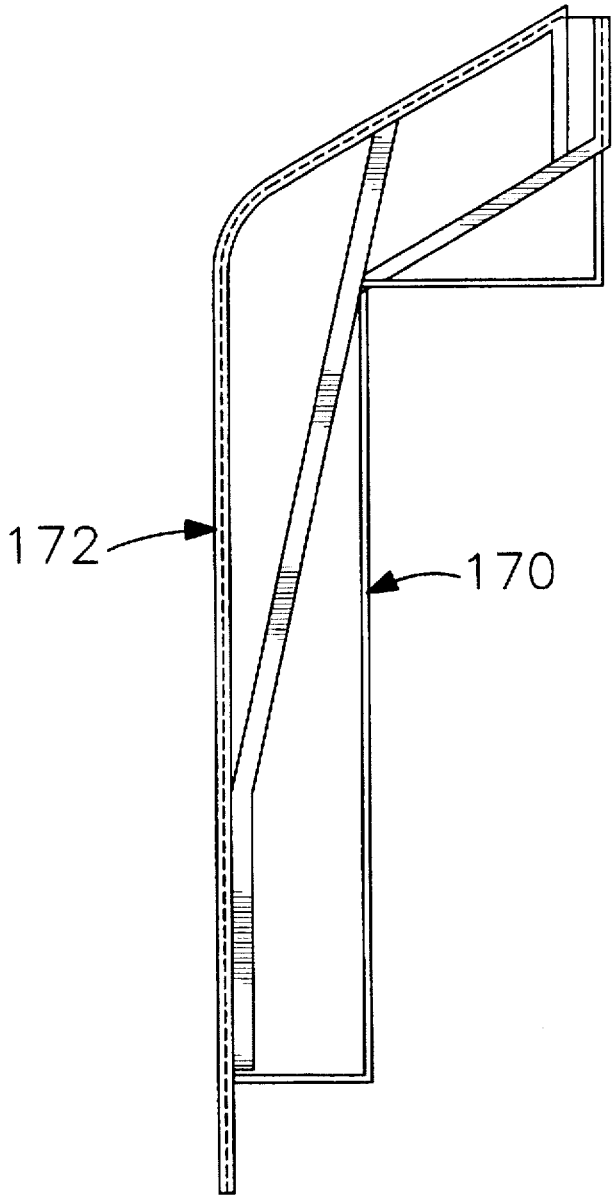
FIG. 7 is an end elevational view of a sheathed stanchion part that inhibits misting between contiguous treatment stations.

FIG. 7 depicts a stanchion 172 having a protective vinyl or metallic covering or sheath 170 that is tack welded, bolted, or otherwise secured thereto. As indicated in FIG. 2, regular stanchions 32 are preferably employed intermediate the treatment stations and sheathed stanchions 172 are employed at the opposite ends of the treatment stations. The sheathing provides a barrier that prevents misting from one stage from passing into an adjacent stage. The size of each sheathing is selected so that transversely spaced apart sheathings are spaced from one another by a distance that allows the parts being cleaned or otherwise treated to pass therebetween with a minimal clearance. Misting from one stage to another is thus minimized by keeping the spacing between opposed sheathings at the minimum distance required by the parts being treated.

In addition to the initial savings associated with building an industrial washer or similar structure in accordance with the teachings of this invention, and the advantages of being able to view the treatment process while it is underway, a number of other advantages are also realized. Inspection of the interior of the apparatus is easy because it can be entered by simply pulling back an edge of a flexible sheet at an overlap location, i.e., no access doors are needed; this reduces the cost of the structure even further. Where a flexible sheet is not of great length, it can be flipped open in its entirety by flinging its bottom edge over the top of the assembly, thereby providing easy access into the uncovered section of the apparatus and enabling ambient light to illuminate the interior of the apparatus.

Where the apparatus is entered by lifting an edge of a flexible sheet at an overlap area, no lighting is required for internal inspections if the ambient lighting is good.

If a forklift truck damages a stanchion, only the stanchion requires replacement, and not an entire metal panel as in the structures heretofore known. Moreover, due to the modular nature of the structure, it is easily expanded or down-sized as applications require, and the time and expense of changing the size of the structure is much less than the time and expense of modifying a conventionally-built structure.

Figure 8:
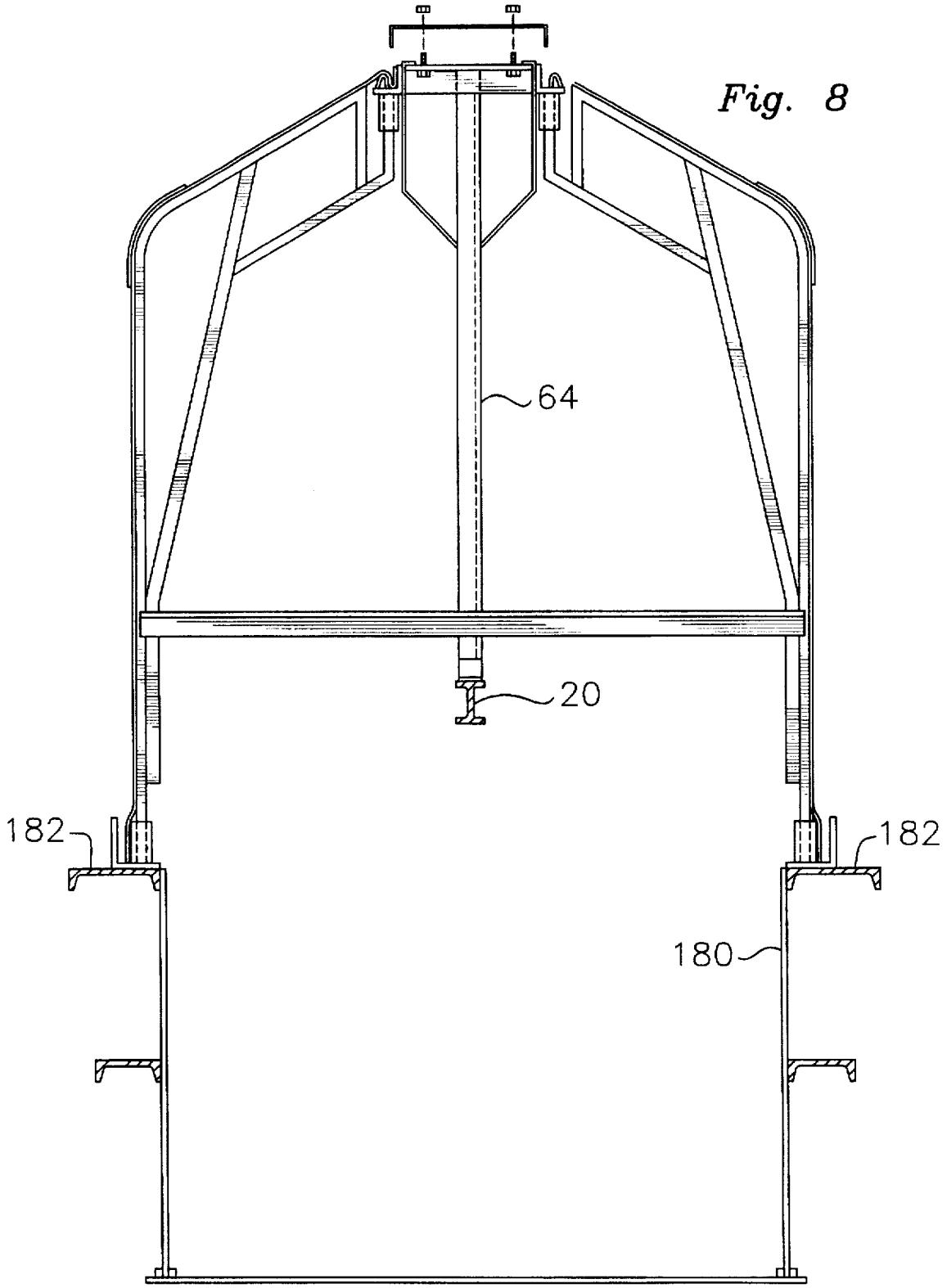
FIG. 8 is an end elevational view indicating how the novel stanchions are mounted when used as the frame means for a dust cover for an immersion tank.

With minor modifications, the novel structure is adaptable for use in numerous applications. For example, as depicted in FIG. 8, it may be used as a dust cover over an immersion tank 180. When so employed, the water-filled trough is not used because the vinyl sheets or metal panels (or metal panels overlying the vinyl sheets) are not subjected to spray; note that the lowermost ends of the stanchions are simply mounted to angle irons 182 that are in turn secured to tank 180 at a predetermined height. Spacer 64 is elongated to position I beam 20 in its operative position.

Figure 9:
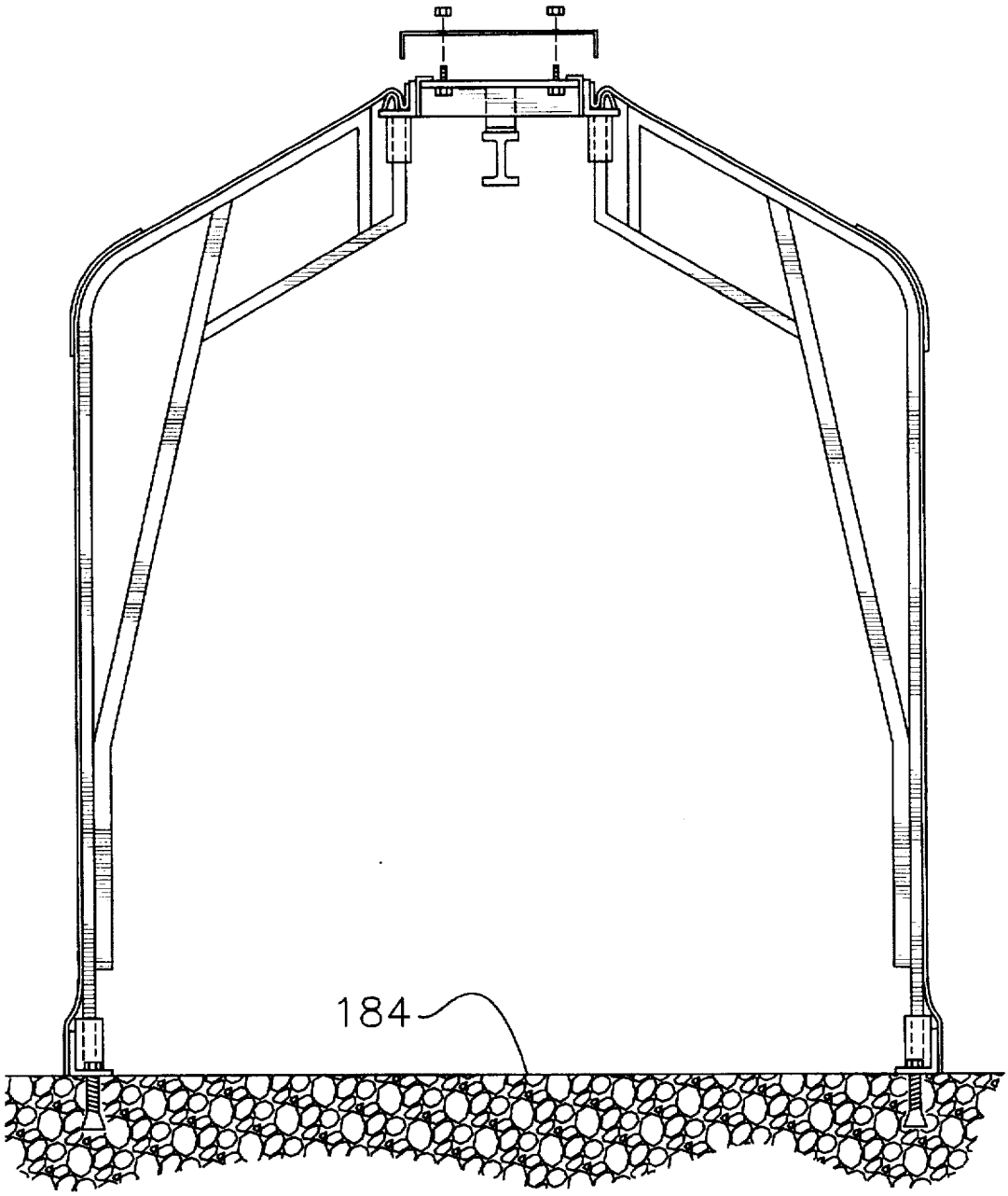
FIG. 9 is an end elevational view indicating how the novel stanchions are mounted when employed as the frame means for a flash tunnel or a dust cover.

When used in a flash tunnel construction or simply as a dust cover with no immersion tank, the lowermost ends of the stanchions are bolted or otherwise suitably secured directly to a floor or other support surface 184 as depicted in FIG. 9.

Figure 10:
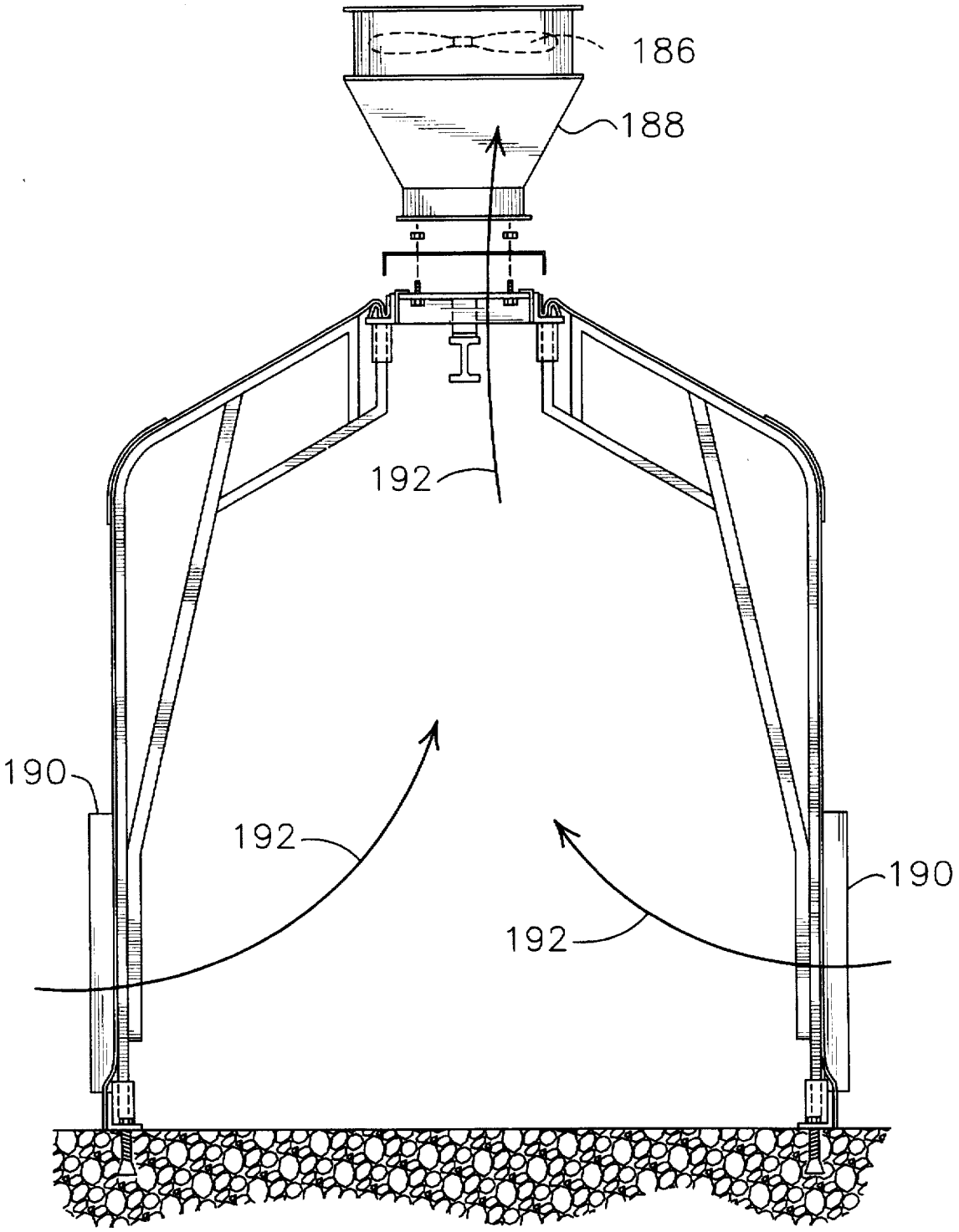
FIG. 10 is an end elevational view indicating how filters can be added to the novel stanchions to provide a cooling tunnel or a flash tunnel.

FIG. 10 depicts a flash tunnel or cooling tunnel application. A draft fan 186 mounted in a vent means in the form of a fan housing 188 may be provided to draw air through filters 190 as indicated by directional arrows 192, or the draft may be allowed to occur naturally without a fan by providing fan housing 188, or its equivalent, without fan 186. Filters 190 are mounted in openings formed in metallic panels 140.

Figure 5A:
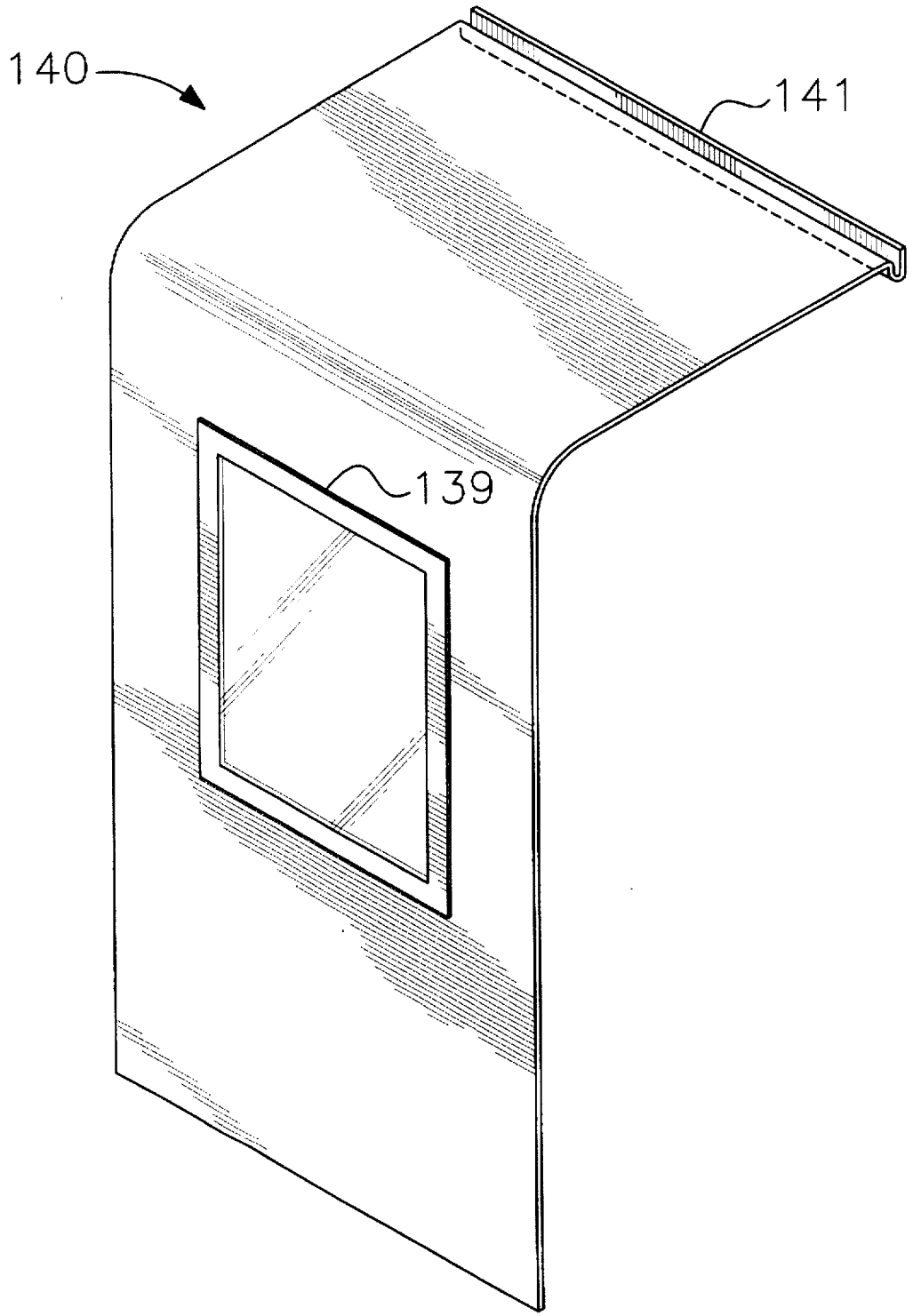
Figure 5B:
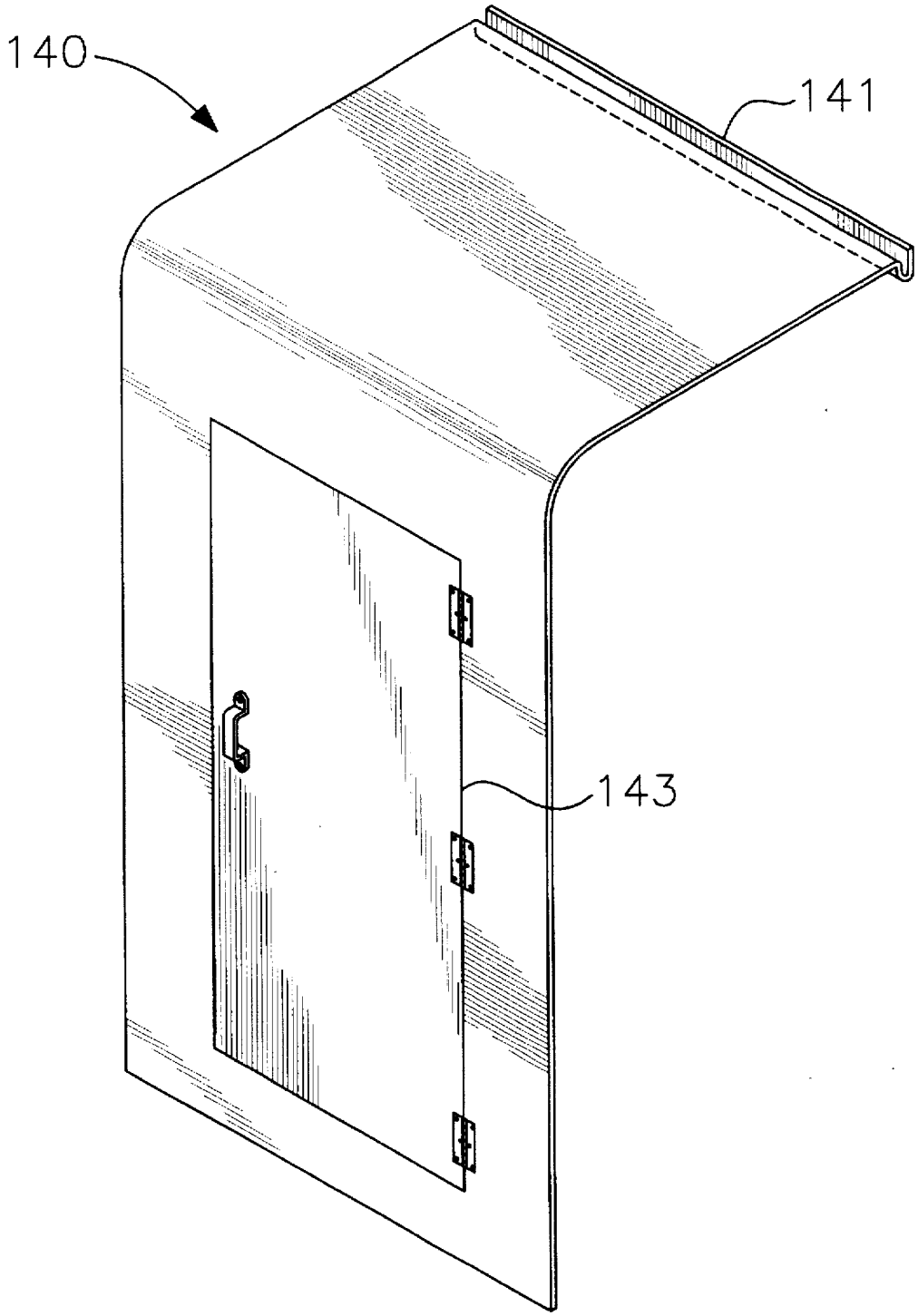

In some applications, such as in cooling tunnels or flash tunnels, the vinyl sheets may be replaced in part or in whole by the metal panels depicted in FIGS. 5A and 5B, by metal panels having no doors or windows, or by metal panels disposed in overlying relation to the vinyl sheets.

The novel stanchions and their flexible or metallic covers and related parts which make up this invention are thus understood to be highly versatile, and this invention is not limited to the specific applications that have been mentioned herein.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A stanchion-supported apparatus, comprising:

a plurality of upstanding stanchions positioned at predetermined intervals along a predetermined extent of said apparatus;

each stanchion of said plurality of stanchions having a generally arch-shaped configuration, said configuration including a pair of transversely spaced apart legs;

each stanchion leg adapted at its lowermost end for engagement to a support surface;

a plurality of sheets of a preselected sheet material disposed in overlying relation to said plurality of stanchions;

a sealing means that inhibits leakage of materials within said apparatus from leaking therefrom; and said sealing means provided in the form of contiguous sheets of said preselected sheet material disposed in overlapping relation to one another at their respective contiguous edges.

2. The apparatus of claim 1, wherein said preselected sheet material is a flexible material.

3. The apparatus of claim 1, wherein said preselected sheet material is a transparent material.

4. The apparatus of claim 1, wherein said preselected sheet material is a flexible, transparent material.

5. The apparatus of claim 1, wherein said preselected sheet material is a metallic panel.

6. The apparatus of claim 5, further comprising a window formed in said metallic panel.

7. The apparatus of claim 5, further comprising a door formed in said metallic panel.

8. The stanchion-supported apparatus of claim 1, further comprising:

a pair of transversely spaced apart elongate troughs for holding materials disposed along said predetermined extent of said apparatus;

each stanchion leg adapted at its lowermost end for engagement to an associated trough; and at least one sheet of said plurality of sheets of preselected sheet material having a lowermost end for immersion in said materials held in an associated trough;

whereby said trough forms a barrier that prevents vapor and said materials from escaping said apparatus.

9. The apparatus of claim 8, further comprising:

a dam formed in each of said troughs at predetermined intervals along their respective extents to prevent mixing of said materials within said troughs.

10. The apparatus of claim 8, further comprising:

a bottom wall disposed along said predetermined extent of said apparatus;

at least one transversely-extending peak formed in said bottom wall;

a pair of downwardly sloped, longitudinally-extending bottom wall sections flanking each peak of said at least one peak so that said materials falling onto said bottom wall on opposite sides of said at least one peak flow in opposite directions away from said at least one peak; and a drain means positioned in remote relation to said at least one peak, said drain means receiving said materials flowing down said bottom wall sections.

11. The apparatus of claim 10, wherein each trough includes an imperforate bottom wall and a pair of imperforate side walls, and wherein an outer side of each trough has an outer side wall having a height greater than an inner side wall of said trough so that any overflow of said trough spills onto said bottom wall of said apparatus.

12. The apparatus of claim 8, wherein each stanchion is formed of three primary parts, said three primary parts being a first and a second stanchion part that exhibit bilateral symmetry with respect to one another, and a top piece interconnecting said first and second parts.

13. The apparatus of claim 12, wherein said top piece is adapted to engage two separate sheets of said preselected sheet material so that an uppermost end of a first sheet of said preselected sheet material is engaged by a first end of said top piece and so that an uppermost end of a second sheet of said preselected sheet material is engaged by a second end of said top piece, whereby opposite sides of said apparatus are covered by separate sheets of said preselected sheet material.

14. The apparatus of claim 13, wherein said top piece is of rigid construction and further comprising a conveyor means supported by said top piece in suspended relation thereto.

15. The apparatus of claim 14, further comprising a pair of top collar members secured to opposite ends of said top piece, and wherein each of said stanchion parts includes an integral post member that is received within an associated collar member of said pair of top collar members.

16. The apparatus of claim 15, further comprising a plurality of bottom collar members positioned at predetermined longitudinally spaced intervals along the extent of said troughs, and wherein each of said stanchion parts includes an integral post member that is received within an associated collar member of said plurality of bottom collar members.

17. The apparatus of claim 12, further comprising:

a vent formed in said top piece of said structure;

an opening formed in a preselected sheet of said plurality of sheets;

a filter means positioned in said opening;

said vent enabling a natural draft to pull air through said filter means and into said structure.

18. The apparatus of claim 17, further comprising:

a forced draft fan positioned in said vent for pulling air into said structure through said filter means.

19. The apparatus of claim 1, further comprising at least one elongate brace means disposed in interconnecting relation to said stanchions to maintain said stanchions in their spaced apart, upright positions.

20. A stanchion-supported apparatus, comprising:

a plurality of upstanding stanchions positioned at predetermined intervals along a predetermined extent of said apparatus;

each stanchion of said plurality of stanchions having a generally arch-shaped configuration, said configuration including a pair of transversely spaced apart legs;

each stanchion leg adapted at its lowermost end for engagement to a support surface;

a plurality of sheets of a preselected sheet material disposed in overlying relation to said plurality of stanchions;

a sealing means that inhibits leakage of materials within said apparatus from leaking therefrom;

said sealing means provided in the form of contiguous sheets of said preselected sheet material disposed in overlapping relation to one another at their respective contiguous edges.

a pair of transversely spaced apart elongate troughs for holding water disposed along said predetermined extent of said apparatus;

each stanchion leg adapted at its lowermost end for engagement to an associated trough; and at least one sheet of said plurality of sheets of preselected sheet material having a lowermost end immersed in water held in an associated trough;

whereby said trough forms a barrier that prevents vapor and chemical spray from escaping said apparatus.

21. The apparatus of claim 20, further comprising:

a dam formed in each of said troughs at predetermined intervals along their respective extents to prevent mixing of chemicals within said troughs.

22. The apparatus of claim 20, further comprising:

a bottom wall disposed along said predetermined extent of said apparatus;

at least one transversely-extending peak formed in said bottom wall;

a pair of downwardly sloped, longitudinally-extending bottom wall sections flanking each peak of said at least one peak so that chemicals falling onto said bottom wall on opposite sides of said at least one peak flow in opposite directions away from said at least one peak; and a drain means positioned in remote relation to said at least one peak, said drain means receiving liquids flowing down said bottom wall sections.

23. The apparatus of claim 22, wherein each trough includes an imperforate bottom wall and a pair of imperforate side walls, and wherein an outer side of each trough has an outer side wall having a height greater than an inner side wall of said trough so that any overflow of said trough spills onto said bottom wall of said apparatus.

24. The apparatus of claim 20, wherein each stanchion is formed of three primary parts, said three primary parts being a first and a second stanchion part that exhibit bilateral symmetry with respect to one another, and a top piece interconnecting said first and second parts.

25. The apparatus of claim 24, wherein said top piece is adapted to engage two separate sheets of material so that an uppermost end of a first sheet of material is engaged by a first end of said top piece and so that an uppermost end of a second sheet of material is engaged by a second end of said top piece, whereby opposite sides of said apparatus are covered by separate sheets of material.

26. The apparatus of claim 25, wherein said top piece is of rigid construction and further comprising:

a conveyor means supported by said top piece in suspended relation thereto.

27. The apparatus of claim 26, further comprising a pair of top collar members secured to opposite ends of said top piece, and wherein each of said stanchion parts includes an integral post member that is received within an associated collar member of said pair of top collar members.

28. The apparatus of claim 27, further comprising:

a plurality of bottom collar members positioned at predetermined longitudinally spaced intervals along the extent of said troughs, and wherein each of said stanchion parts includes an integral post member that is received within an associated collar member of said plurality of bottom collar members.

29. The apparatus of claim 23, further comprising:

a vent formed in said top piece of said structure;

an opening formed in a preselected sheet of said plurality of sheets;

a filter means positioned in said opening;

wherein said vent enabling a natural draft to pull air through said filter means and into said structure.

30. The apparatus of claim 29, further comprising:

a forced draft fan positioned in said vent for pulling air into said structure through said filter means.

* * * * *